United States Patent [19]

Matsumoto

[11] Patent Number: 4,475,460

[45] Date of Patent: Oct. 9, 1984

[54] PROCESS FOR DESENSITIZING LITHOGRAPHIC PRINTING PLATES

[75] Inventor: Hiroshi Matsumoto, Shizuoka, Japan

[73] Assignee: Fuji Photo Film Co., Ltd., Kanagawa, Japan

[21] Appl. No.: 539,212

[22] Filed: Oct. 5, 1983

[30] Foreign Application Priority Data

Oct. 5, 1982 [JP] Japan ..... 57-175197

[51] Int. Cl.[3] ..... B41N 3/08

[52] U.S. Cl. ..... 101/465; 101/451; 106/2

[58] Field of Search ..... 101/451, 465; 106/2

[56] References Cited

U.S. PATENT DOCUMENTS

| | | | |
|---|---|---|---|
| 3,860,426 | 1/1975 | Cunningham et al. | 101/453 |
| 4,024,085 | 5/1977 | Kobayashi et al. | 252/136 |
| 4,072,527 | 2/1978 | Fan | 96/87 R |
| 4,072,528 | 2/1978 | Bratt | 96/87 R |
| 4,095,525 | 6/1978 | Taukada et al. | 101/465 |
| 4,123,279 | 10/1978 | Kobayashi | 96/91 D |
| 4,348,954 | 9/1982 | Okishi | 101/465 |

FOREIGN PATENT DOCUMENTS

| | | |
|---|---|---|
| 1235281 | 6/1971 | United Kingdom . |
| 1460978 | 1/1977 | United Kingdom . |
| 1495861 | 12/1977 | United Kingdom . |
| 1505739 | 3/1978 | United Kingdom . |
| 2010298 | 6/1979 | United Kingdom . |

*Primary Examiner*—Lorenzo B. Hayes

*Attorney, Agent, or Firm*—Sughrue, Mion, Zinn, Macpeak & Seas

[57] ABSTRACT

A process for desensitizing lithographic printing plates is described. The gum for the process comprises an aqueous solution containing a film-forming starch derivative modified with polyoxyethylene or a polyoxyethylene-polyoxypropylene copolymer. The gum reduces the number of spoiled copies printed and the amount of staining on non-image areas.

6 Claims, No Drawings

PROCESS FOR DESENSITIZING LITHOGRAPHIC PRINTING PLATES

FIELD OF THE INVENTION

The present invention relates to a desensitizing gum for lithographic printing plates.

BACKGROUND OF THE INVENTION

In making lithographic printing plates, a step of coating a desensitizing gum, called a gumming-up step, is provided as a final step for protecting non-image areas (areas which retain water in order to repel a printing ink).

The purposes of applying the desensitizing gum to non-image areas are not only to protect the hydrophilic character of the non-image areas but also to protect the non-image areas from being stained or flawed by adhesion of fingerprints, fats and oils, dusts, etc. upon correction of image areas such as retouching or erasure; during storage before printing and after plate making or before re-use; and, upon handling to mount the printing plate on a press. In addition, application of desensitizing gum acts to suppress oxidative stains.

As the gum composition for lithographic printing plates, compositions comprising an aqueous solution of gum arabic, cellulose gum or a water-soluble high molecular weight substance containing carboxy groups in the molecule and optionally containing a pH-adjusting agent, an antiseptic, etc. have so far been popularly used.

However, these conventionally known compositions have a disadvantage in that the compositions can cause image blinding at initial press. In the final step of finishing a printing plate, a gum solution is applied to the printing plate and spread all over the plate surface using a sponge or cotton pad. This step is followed by polishing the plate surface with a cotton pad or a cloth wipe until the surface dries. Upon this surface a water-soluble high molecular weight substance is thickly coated, in part on image areas (areas which receive an ink). The thickly coated image areas have such a poor ink receptivity in printing that many copies must be printed before the image fully accepts ink. Where this phenomenon, generally called image blinding at initial press, takes place, generally the plate must be subjected to a step of washing with water or with a weakly acidic solution to thereby remove the hydrophilic colloid absorbing on the image areas. This washing step consumes considerable time, and in attempts to make this time consuming step easier, a removing solution for gum has been developed as described in U.S. Pat. No. 4,024,085.

Alternatively, image areas can be coated with fats and oils before the gumming-up step for the purpose of protecting the ink-receptive properties of the image areas. However, this makes the plate-making step complicated and reduces workability. In addition, disposal of waste liquor can aggravate pollution and be a health hazard.

Water-soluble organic high molecular weight compounds which do not cause image blinding also have been developed as desensitizing gums. For example, U.S. Pat. No. 4,095,525 and British Pat. No. 2,010,298, West German Pat. No. 2,504,594, and Soviet Pat. No. 623,755 disclose dextrin, pullulan and its derivatives, carboxy-containing polyacrylamide derivatives, methyl acrylate- or methacrylate-grafted polyacrylamide copolymers, etc. However, these compounds have a disadvantage in that the desensitizing action on non-image areas is poor.

SUMMARY OF THE INVENTION

Accordingly, one object of the present invention is to provide a desensitizing gum which exerts an excellent desensitizing action on non-image areas of a lithographic printing plate and which does not cause image blinding of image areas even when the plate is stored for a long period of time.

Another object of the present invention is to provide a desensitizing gum which can be easily applied to a printing plate using a sponge, a cotton pad or an automatic gum coater, which can be easily removed from the lithographic printing plate by washing with water or by bringing the plate into contact with dampening rollers on a lithographic press, and which retains good hydrophilic properties in non-image areas.

As a result of investigations for attaining the above-described objects, the inventors have developed the present invention.

The above-described objects can be accomplished by using as a desensitizing gum an aqueous solution of a film-forming starch derivative modified with polyoxyetheylene or a polyoxyethylene-polyoxypropylene copolymer.

DETAILED DESCRIPTION OF THE INVENTION

The starch derivative modified with polyoxyethylene or a polyoxyethylene-polyoxypropylene copolymer is a starch derivative prepared by chemically modifying a starch such as potato starch, sweet potato starch, wheat starch, corn starch, tapioca starch or rice starch with polyoxyethylene or a polyoxyethylene-polyoxypropylene copolymer. More particularly, the starch derivative is prepared by addition-polymerization of ethylene oxide or propylene oxide with the hydroxy groups in the straight chain or branched chain of the starch molecule. The starch derivative so prepared is a high molecular weight compound containing the units represented by the following general formula (I) and the units represented by the following general formula (II):

[I]

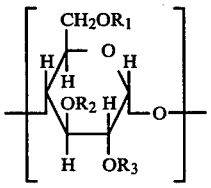

wherein $R_1$, $R_2$, and $R_3$ represent a hydrogen atom, $-(CH_2CH_2O)_n-H$, or $$-(CH_2CH_2O)_p-(\underset{\underset{CH_3}{|}}{CH}-CH_2O)_q-(CH_2CH_2O)_r-H,$$

wherein n represents an integer of 1 to 1,000 p and r each represents an integer of 0 to 1,000, provided that p and r do not represent 0 at the same time, and q represents an integer of 1 to 100; and wherein $R_1$, $R_2$ and $R_3$ may be the same or different, provided that at least one of $R_1$, $R_2$, and $R_3$ represents a group other than a hydrogen atom.

[II]

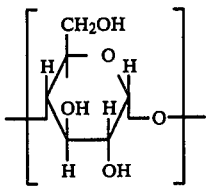

The degree of modification with polyoxyethylene or polyoxyethylene-polyoxypropylene copolymer can be varied over a wide range, but as a general guide, the modification is conducted to such a degree that a resulting modified starch has a solubility of 5 wt % or more, preferably 10 wt % or more, in water at 20° C.

The molecular weight of the modified starch is preferably adjusted so that a 20 wt % aqueous solution at 20° C. has a viscosity of 5 to 20 cps.

The above described starch derivative is synthesized according to the following reactions:

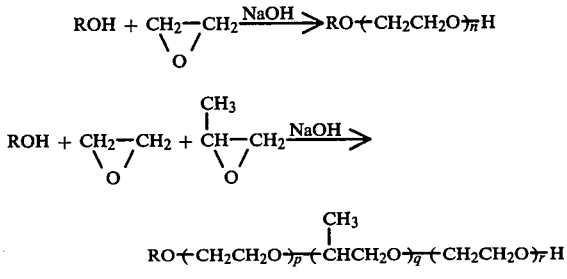

wherein R—OH represents a starch, and n, p, q, and r have the definitions above.

Necessary performance of the derivative can be obtained by selecting the substituents of the derivative. For instance, the ethylene oxide moiety influences an ink repelling property and the propylene oxide moiety influences an ink receptive property.

The content of the polyoxyethylene or polyoxyethylene-polyoxypropylene copolymer-modified starch in the desensitizing gum of the present invention preferably ranges from 5 to 35 wt %, more preferably from 10 to 25 wt %. These modified starches are used as a uniform aqueous solution by dissolving the starches in water.

In the present invention, the modified starch may be used in combination with other starches such as dextrin. In addition, other water-soluble high molecular weight compounds may be added thereto.

In general, the desensitizing gum is advantageously acidic, i.e., having a pH ranging from 3 to 6. In order to adjust the pH value to 3 to 6, a mineral acid, an organic acid or an inorganic salt is generally added to the desensitizing gum in an amount of 0.01 to 2 wt %. Examples of the mineral acid include nitric acid, sulfuric acid, phosphoric acid, etc. Examples of the organic acid include citric acid, acetic acid, oxalic acid, malonic acid, p-toluenesulfonic acid, tartaric acid, malic acid, lactic acid, levulinic acid, organophosphonic acid, etc. Examples of the inorganic salt include magnesium nitrate, sodium primary phosphate, sodium secondary phosphate, nickel sulfate, sodium hexametaphosphate, sodium tripolyphosphate, etc. These mineral acids, organic acids, and inorganic salts may be used alone or in combination of two or more.

A surfactant may also be added to the desensitizing gum of the present invention. Addition of a surfactant serves to improve the plane properties of the coating layer. As the surfactant, anionic surfactants and nonionic surfactants can be used.

Examples of anionic surfactants which can be used in the present invention include aliphatic alcohol sulfuric esters, aliphatic alcohol phosphoric esters, sulfonates of dibasic fatty acid esters, fatty acid amidosulfonates, alkylarylsulfonates, formaldehydecondensed naphthalenesulfonates, etc.

Examples of nonionic surfactants which can be used in the present invention include polyethylene glycol alkyl ethers, polyethylene glycol alkyl esters, sorbitan alkyl esters, polyoxypropylene-polyoxyethylene ethers. These surfactants may be used alone or in combination of two or more. The amount of the surfactant to be used is not particularly limited, but preferably the amount of surfactant ranges from 0.01 to 10 wt % based on the desensitizing gum.

In addition to the above-described components, lower alcohols such as glycerin, ethylene glycol, triethylene glycol, etc. may be used as wetting agents. These wetting agents are used in amounts ranging from 0.1 to 5.0 wt %, preferably from 0.5 to 3.0 wt %, in the resulting composition.

Antiseptics may also be added to the desensitizing gum of the present invention. For example, benzoic acid and its derivatives, phenol, formalin, sodium dehydroacetate, etc. may be added in amounts of 0.005 to 2.0 wt %.

The desensitizing gum of the present invention can be applied to various lithographic printing plates, particularly preferably to lithographic printing plates obtained by imagewise exposing and developing presensitized lithographic printing plates (printing plates having a previously given light-sensitivity which are called PS plates) comprising a support of an aluminum plate having provided thereon a light-sensitive layer. Preferable examples of such PS plates include: PS plates comprising an aluminum plate support having provided thereon a light-sensitive layer composed of a mixture of diazo resin (salt of a condensate between p-diazodiphenylamine and paraformaldehyde) and shellac as described in British Pat. No. 1,350,521; negative-working PS plates comprising an aluminum support having provided thereon a light-sensitive layer composed of a mixture of diazo resin and a polymer having hydroxyethyl methacrylate units or hydroxyethyl acrylate units as major repeating units, as described in British Pat. Nos. 1,460,978 and 1,505,739; and positive-working PS plates comprising an aluminum plate having provided thereon a light-sensitive layer composed of a mixture of an o-quinonediazide light-sensitive compound and a novolak type phenol resin, as described in U.S. Pat. No. 4,123,279. Further, PS plates comprising an aluminum plate having provided thereon a light-sensitive layer of photo-cross-linkable photopolymer specifically described in U.S. Pat. No. 3,860,426, PS plates comprisng an aluminum support having provided thereon a light-sensitive layer of photopolymerizable photopolymer composition as described in U.S. Pat. Nos. 4,072,528 and 4,072,527, and PS plates comprising an aluminum plate having provided thereon a light-sensitive layer composed of a mixture of an azide and a water-soluble polymer as described in British Pat. Nos. 1,235,281 and 1,495,861 are also preferable.

One embodiment of applying the desensitizing gum of the present invention to a PS plate is described below.

A PS plate is first imagewise exposed, then developed to prepare a lithographic printing plate. This lithographic printing plate is washed with water and, after squeezing away the water on the plate surface, a suitable amount of the desensitizing gum of the present invention is applied to the plate surface, followed by rubbing with a sponge so as to spread the gum all over the plate surface. Thus, non-image areas of the printing plate are protected, and the resulting lithographic printing plate can be stored. In order to starting printing, the gum on the plate surface is washed away, and subsequent procedures are conducted in a usual manner to print copies.

The use of the desensitizing gum of the present invention eliminates the necessity of using an oily protective ink conventionally used for retaining ink-receptive properties of image areas and allows the gum to be uniformly coated by an automatic gum coater or the like. Upon printing, sufficiently sharp and clear copies can be obtained almost immediately without first producing a multitude of spoiled copies as has been encountered in the prior art.

The present invention will now be described in more detail by reference to non-limiting Examples.

EXAMPLE 1

200 parts by weight of a water-soluble, polyoxyethylenemodified starch (polymerization degree of oxyethylene: 2.5 to 5) was dissolved in 791.9 parts by weight of pure water. The resulting solution had a viscosity at 25° C. of 14 cps. Five parts by weight of a 33% aqueous solution of an anionic surfactant, sodium isopropylnaphthalenesulfonate, 0.1 part by weight of ethyl benzoate, and 3.0 parts by weight of phosphoric acid (85%) were added thereto to prepare a desensitizing gum of the present invention.

A 0.24 mm thick aluminum plate was dipped in a 7% aqueous solution of sodium tertiary phosphate (kept at 60° C.) in order to degrease the plate, and then the plate was washed with water and rubbed with a nylon brush to grain while applying thereto a suspension of pumice in water. The aluminum plate then was dipped in a 5% aqueous solution of potassium silicate ($SiO_2/K_2O$ molar ratio: 2.0), kept at 70° C. for 30 to 60 seconds, washed well with water, and dried.

A light-sensitive solution composed of 2.0 parts by weight of a 2-hydroxyethyl methacrylate copolymer (prepared according to Example 1 in British Pat. No. 1,505,739), 0.12 part by weight of a 2-methoxy-4-hydroxy-5-benzoylbenzenesulfonic acid salt of a condensate between p-diazodiphenylamine and paraformaldehyde, 0.03 part by weight of Oil Blue #603 (made by Orient Kagaku Kogyo Kabushiki Kaisha), 15 parts by weight of 2-methoxyethanol, 10 parts by weight of methanol, and 5.0 parts by weight of ethylene chloride was coated on the aforesaid aluminum support in a dry weight of 1.8 g/m$^2$ to obtain a presensitized lithographic printing plate.

This printing plate was exposed using a half tone negative transparency, developed with an aqueous developing solution composed of 3.0 parts by weight of sodium sulfite, 30.0 parts by weight of benzyl alcohol, 20.0 parts by weight of triethanolamine, 5.0 parts by weight of monoethanolamine, 10.0 parts by weight of sodium t-butylnaphthalenesulfonate, and 1,000 parts by weight of pure water, washed with water, and dried.

The thus-obtained printing plate was cut into three pieces. One piece of the plate was coated with an aqueous solution of gum arabic (about 15% aqueous solution) having a specific gravity of 7° Bé and having been conventionally used as a desensitizing gum, followed by wiping off excess gum with a cloth to prepare sample A.

A second piece was coated with the above-prepared desinsitizing gum of the present invention, followed by similarly wiping off excess gum with a cloth to prepare sample B.

The third piece was not coated with any desensitizing gum and was used as such (sample C).

Samples A, B, and C were placed in a thermohygrostat at 45° C. and 85% humidity for 3 days, then mounted on a press (Heidelberg KOR-D) for printing in a conventional manner.

With sample A, 100 or more spoiled copies had to be printed before sharp and clear copies were obtained. With samples B and C, 10 and 8 spoiled copies, respectively, had to be printed before sharp and clear copies were obtained.

With respect to stain during printing, samples A and B did not stain, whereas sample C was extremely easily stained. Thus, sample B, which used the desensitizing gum of the present invention, was found to be excellent in ink-receptive properties of image areas and ink-repelling properties of non-image areas.

EXAMPLE 2

200 parts by weight of a water-soluble, polyoxyethylene-polyoxypropylene block copolymer-modified starch, 5.0 parts by weight of a 40% aqueous solution of sodium alkyldiphenyl ether disulfonate, 0.3 part by weight of sodium dehydroacetate, 2.0 parts by weight of citric acid, and 2.0 parts by weight of magnesium sulfate were dissolved in 790.7 parts by weight of pure water to prepare a desensitizing gum. This desensitizing gum had a viscosity of 18.0 cps at 25° C.

Separately, 1 part by weight of a naphthoquinone-1,2-diazido-5-sulfonic ester of polyhydroxyphenyl obtained by polycondensation of acetone and pyrogallol described in Japanese Patent Publication No. 28403/68 and 2 parts by weight of a novolak type cresol-formaldehyde resin were dissolved in 40 parts by weight of Methyl Cellosolve ® (2-methoxyethanol) to prepare a light-sensitive solution.

A 0.2-mm thick, grained aluminum plate was well washed and dried, and the above-described light-sensitive solution was coated on the aluminum plate using a rotary coater to prepare a positive-working presensitized printing plate having a light-sensitive layer of a thickness of about 2.0 g/m$^2$. This plate was exposed using a half tone positive transparency, developed with a 3% sodium silicate aqueous solution, washed with water, and dried.

The resulting printing plate was cut into three pieces. One piece of the plate was coated with a 14° Bé gum arabic (about 27% aqueous solution of gum arabic), which is conventionally used as a desensitizing gum, followed by wiping off excess gum with a cloth to prepare sample A.

A second piece was coated with the above-prepared desensitizing gum of the present invention, followed by similarly wiping off excess gum with a cloth to prepare sample B.

The third piece was not eoated with any desensitizing gum and was used as such (sample C).

Samples A, B, and C were placed in a thermohygrostat at 45° C. and 85% humidity for 7 days, then mounted on a press (Heidelberg KOR-D) for printing in a conventional manner.

With sample A, 35 copies had to be printed before sharp and clear copies were obtained. With samples B and C, 5 and 3 spoiled copies, respectively, had to be printed before sharp and clear copies were obtained. With respect to stain during printing, samples A and B did not stain, whereas sample C was extremely easily stained. Thus, sample B, which used the desensitizing gum of the present invention, was found to be excellent in ink-receptive properties of image areas and ink-repelling properties of non-image areas.

EXAMPLE 3

A desensitizing gum composed of 200 parts by weight of polyethylene oxide-modified, enzyme-decomposed starch prepared by addition-polymerizing ethylene oxide onto an enzyme-decomposed starch (trade name: Amycol; made by Nichiden Chemical Corporation), 0.5 part by weight of sodium salt of lauryl alcohol sulfate (trade name: Monogen Y-100; made by Dai-ichi Kogyo Seiyaku Co., Ltd.), 2.5 parts by weight of a sodium naphthalenesulfonate-formalin condensate (trade name Demol P; made by Kao Atlas Co., Ltd.), 1.0 part by weight of phosphoric acid (85%), 3.0 parts by weight of sodium hexametaphosphate, and 793.0 parts by weight of pure water was prepared. This desensitizing gum had a viscosity of 12 cps at 25° C. A presensitized printing plate obtained in the same manner as in Example 1 was exposed to an image, developed, dried, and cut into three pieces.

One piece of the plate was coated with 14° Bé gum arabic, followed by wiping off excess gum with a cloth to prepare sample A. A second piece was coated with the above-prepared desensitizing gum of the present invention, followed by wiping off excess gum with a cloth to prepare sample B. The third piece was not coated with any desensitizing gum and was used as such (sample C).

Samples A, B, and C were placed in a thermohygrostat of 45° C. and 85% humidity for 7 days as in Example 1, then mounted on a press (Heidelberg KOR-D) for printing.

With sample A, more than 100 spoiled copies had to be printed before sharp and clear copies were obtained, and with samples B and C, only 8 and 5 spoiled copies, respectively, had to be printed before sharp and clear copies were obtained. Sample C was extremely easily stained during printing, although samples A and B did not stain. The desensitizing gum used for sample B was found to be extremely satisfactory.

EXAMPLE 4

100 parts by weight of the same water-soluble, polyoxyethylene-modified starch as that used in Example 1, 100 parts by weight of cream dextrin, 2.0 parts by weight of polyoxyethylene alkylphenyl ether (trade name: Emalgen #903; made by Kao Atlas Co., Ltd.), 1.0 part by weight of phosphoric acid (85%), 1.0 part by weight of citric acid, 3.0 parts by weight of ammonium primary phosphate, 0.2 part by weight of sodium dehydroacetate, and 0.2 part by weight of ethyl benzoate were dissolved in 792.6 parts by weight of pure water to prepare a desensitizing gum. This desensitizing gum had a viscosity of 25 cps. When this gum was used as a desensitizing gum for the positive-working presensitized printing plate used in Example 2, it was found that, even after placing the plate at 45° C. and 85% humidity for 7 days, only 7 spoiled copies had to be printed before sharp and clear copies were obtained, and no stains occurred. Thus, the gum had an extremely satisfactory performance as a desensitizing gum.

While the invention has been described in detail and with reference to specific embodiments thereof, it will be apparent to one skilled in the art that various changes and modifications can be made therein without departing from the spirit and scope thereof.

I claim:

1. A process for desensitizing a lithographic printing plate having a hydrophilic non-image area and a lipophilic image area comprising coating said plate with a desensitizing gum comprising an aqueous solution containing a film-forming starch modified with polyoxyethylene or a polyoxyethylene-polyoxypropylene copolymer.

2. The process of claim 1, wherein said starch is selected from the group consisting of potato starch, sweet potato starch, wheat starch, corn starch, tapioca starch and rice starch.

3. The process of claim 1, wherein the degree of modification of the starch with polyoxyethylene or polyoxyethylene-polyoxypropylene copolymer is conducted to such degree that the resulting modified starch has a solubility of 5 wt % or more in water at 20° C.

4. The process of claim 1, wherein the degree of modification of the starch with polyoxyethylene or polyoxyethylene-polyoxypropylene copolymer is conducted to such a degree that the resulting modified starch has a solubility of 10 wt % or more in water at 20° C.

5. The process of claim 1, wherein the content of the polyoxyethylene or polyoxyethylene-polyoxypropylene copolymer-modified starch in the desensitizing gum is in a range of from 5 to 35 wt %.

6. The process of claim 1, wherein the content of the polyoxyethylene or polyoxyethylene-polyoxypropylene copolymer-modified starch in the desensitizing gum is in a range of from 10 to 25 wt %.

* * * * *